United States Patent [19]

Smits et al.

[11] Patent Number: 4,638,500

[45] Date of Patent: Jan. 20, 1987

[54] METHOD OF DETERMINING VOLTAGE AND CURRENT FOR A GIVEN OPERATING PERIOD OF AN X-RAY SOURCE

[75] Inventors: Wigle F. Smits, Emmasingel; Willem E. Spaak, Eindhoven, both of Netherlands

[73] Assignee: U.S. Philips Corporation, New York, N.Y.

[21] Appl. No.: 659,427

[22] Filed: Feb. 19, 1976

Related U.S. Application Data

[63] Continuation of Ser. No. 512,920, Oct. 7, 1974, abandoned.

[51] Int. Cl.[4] ..... H05G 1/46

[52] U.S. Cl. ..... 378/109; 378/111; 378/121; 378/207

[58] Field of Search ..... 250/408, 409, 410, 411, 250/412; 378/114, 115, 117, 118, 109, 111, 121

[56] References Cited

U.S. PATENT DOCUMENTS 2,936,376 5/1960 Hoekstra ..... 250/409

FOREIGN PATENT DOCUMENTS 587218 2/1932 Fed. Rep. of Germany ..... 250/409
1245502 7/1967 Fed. Rep. of Germany ..... 250/409
2448309 4/1975 Fed. Rep. of Germany ..... 250/409

*Primary Examiner*—Craig E. Church
*Assistant Examiner*—T. N. Grigsby
*Attorney, Agent, or Firm*—Robert T. Mayer; Bernard Franzblau

[57] ABSTRACT

A method of determining the optimum values of voltage and current for operation of an X-ray source by choosing a point of intersection at the lowest voltage value of a curve representing an operating range limitation function of the X-ray source with a curve representing a current-voltage function that passes through a desired operating current value that is determined by means of one or more exposure measurements.

6 Claims, 5 Drawing Figures

METHOD OF DETERMINING VOLTAGE AND CURRENT FOR A GIVEN OPERATING PERIOD OF AN X-RAY SOURCE

This is a continuation of application Ser. No. 512,920, filed Oct. 7, 1974, and now abandoned.

The invention relates to a method of and apparatus for determining the voltage and current values to be applied to an X-ray source during a given actuation period of the X-ray source, the X-ray source having a given operating range limitation nomogram, and in which a desired current time product for the X-ray source is determined with the aid of an X-ray exposure meter to provide a desired radiation quantity dose.

Such a method is usually based on experience and is performed by those skilled in the art of operating X-ray equipment.

The invention has for its object to simplify this method so that those less experienced and skilled in the art of operating X-ray equipment also can perform this method with a very favorable result.

To this end a method of the kind described in the preamble and according to the invention is characterized in that the current time product is determined at a given voltage applied to the radiation source while with the aid of a voltage-current function which applies to the desired radiation quantity, which function, is passed through the current intensity associated with the desired current time product, and with the aid of the operating range limitation nomogram with the same current scale as the voltage-current function, the point of intersection of the voltage-current function and the operating range limitation nomogram with the lowest voltage value is determined, and that said lowest voltage value is taken as a target value for the determination of the current with the aid of the load nomogram.

A circuit arrangement for performing such a method is characterized in that the X-ray exposure meter includes a circuit for determining the logarithm of the desired current value associated with the applied voltage and a chosen period and for supplying a voltage proportional to this logarithms to its output which is coupled to a first input of an adder and subtractor circuit, a second input of which is coupled to an output of a clamping circuit an input of which is coupled to an output of a voltage-current function generator which supplies an output voltage proportional to the logarithm of a current value associated with an input voltage. A third input of the adder and subtractor circuit is coupled to an output of an operating range limitation nomogram function generator supplying an output voltage proportional to the logarithm of a current value associated with an input voltage. An input of said function generators is coupled to an output of the adder and subtractor circuit, said output being furthermore coupled to a control signal input of a voltage control circuit of the radiation source.

The invention will be described in greater detail with reference to the accompanying drawing in which.

Figure 1:
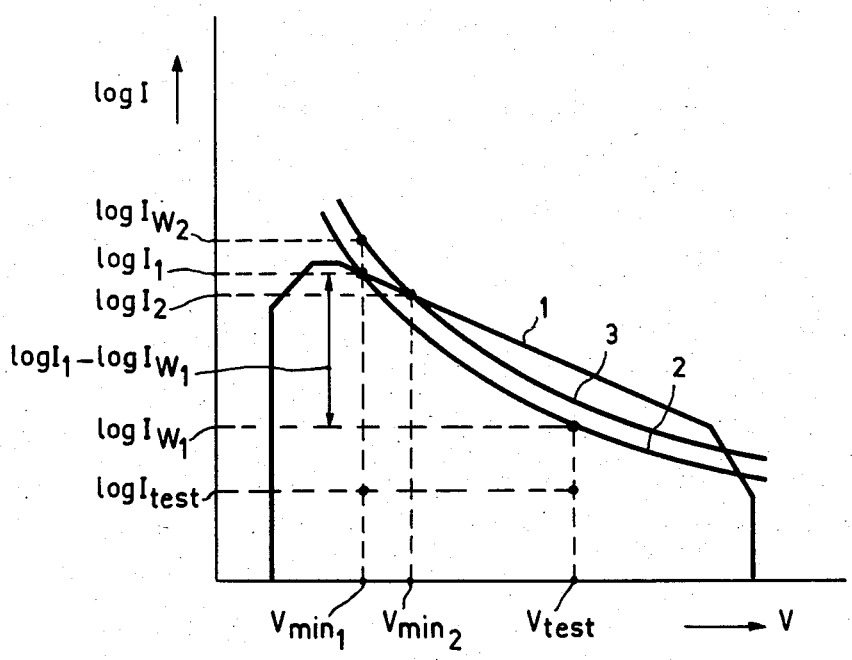
Figure 2:
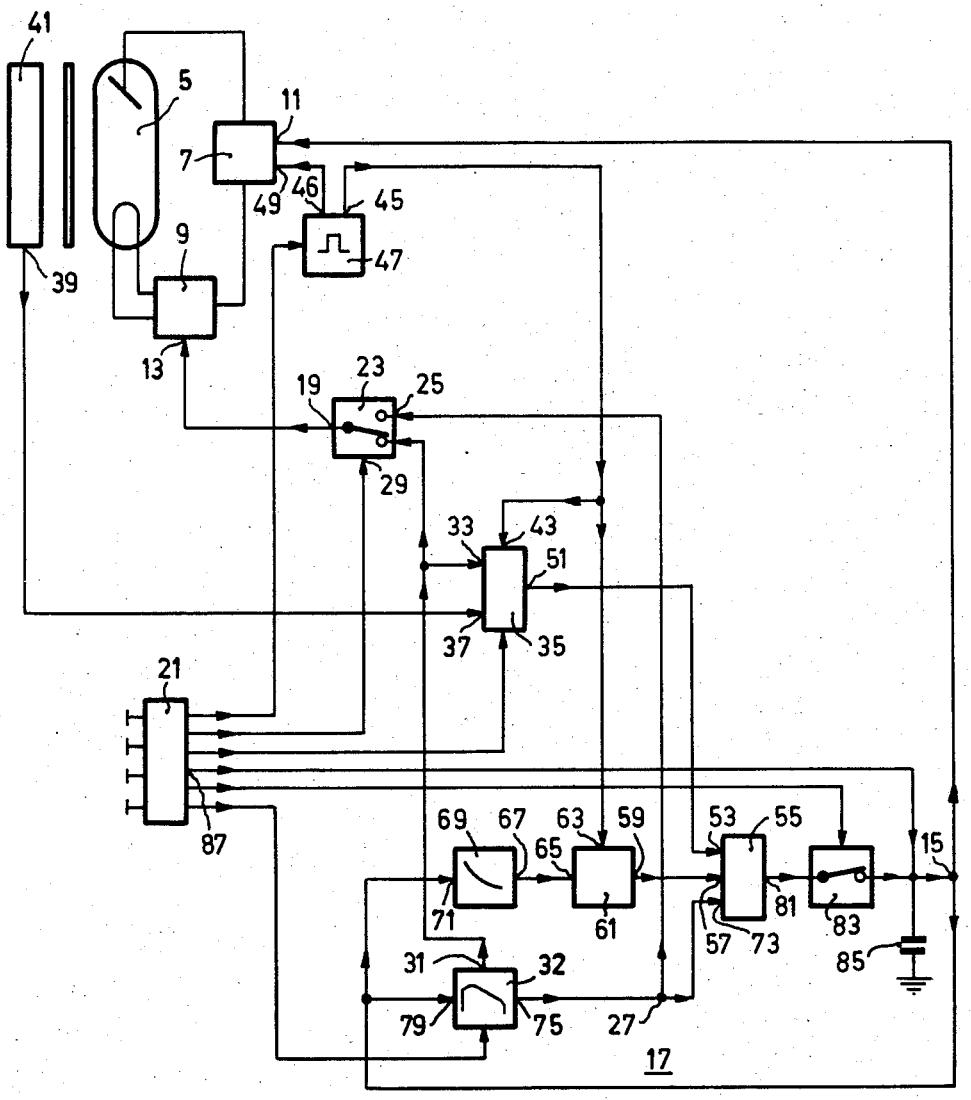
Figure 3:
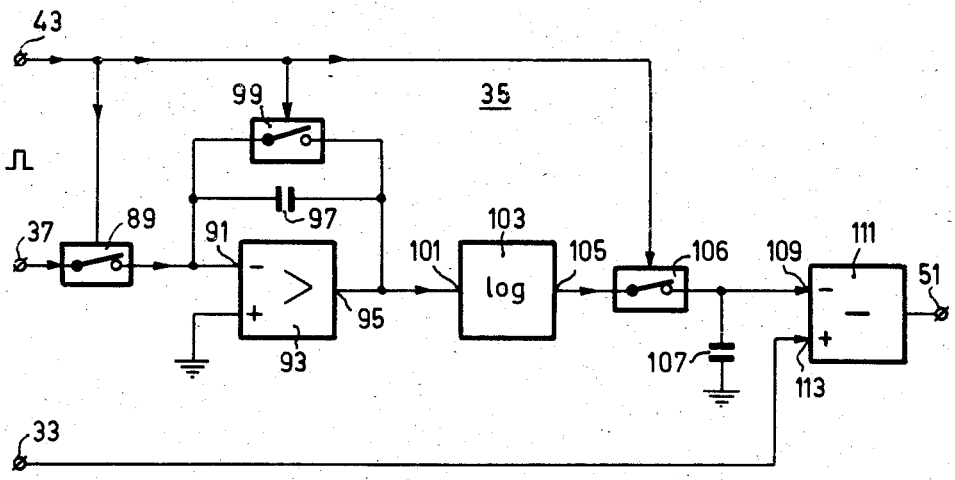
Figure 4:
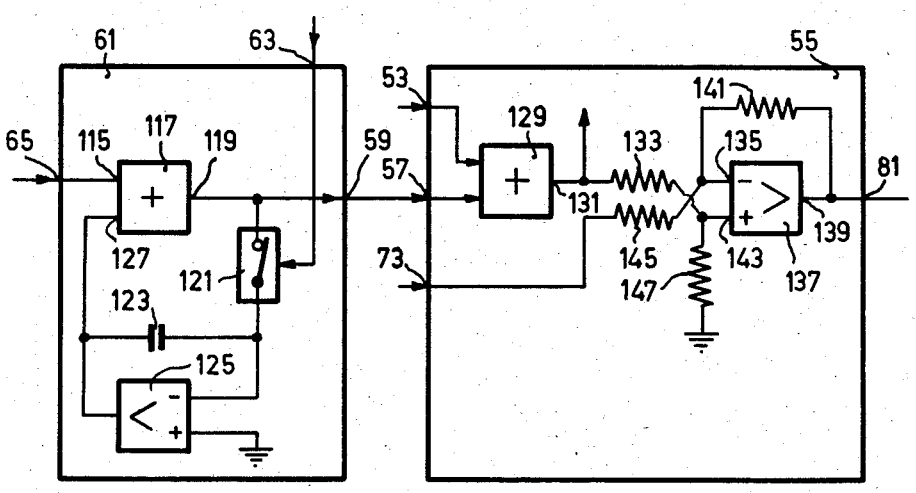
Figure 5:
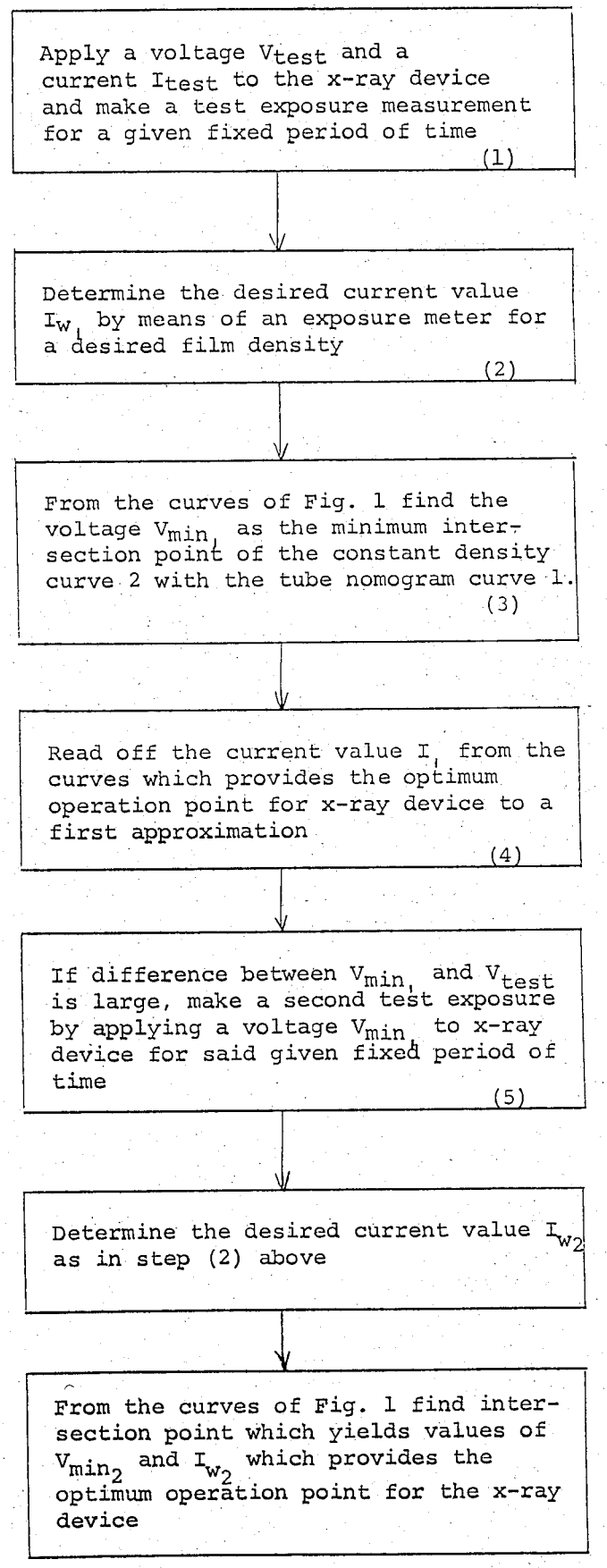

FIG. 1 shows a voltage-current characteristic relating to the operation of an X-ray tube useful in describing the method according to the invention, FIG. 2 illustrates by way of a block-schematic diagram a circuit arrangement for performing method, FIG. 3 illustrates by way of a block-schematic diagram an X-ray exposure meter for the circuit arrangement of FIG. 2, FIG. 4 shows by way of a block-schematic diagram a clamping circuit and an adder and subtractor circuit for a circuit arrangement of FIG. 2, FIG. 5 shows a flow chart of the novel method.

The novel method will become apparent by reference to FIGS. 1 and 6 of the drawing and the following description.

FIG. 1 shows a voltage-current range for voltage and currents of an X-ray source with a logarithmic current scale denoted by log I on the vertical axis and a voltage scale which, if desired, may also be logarithmic, but is denoted by V on the horizontal axis.

Furthermore the reference numeral 1 denotes an operating range limitation nomogram of an X-ray source and 2 and 3 denote some curves corresponding to some radiation quantities suitable for photo or film for observation purpose obtained by irradiation of an object.

The operating range limitation nomogram 1 of the X-ray source under pick-up conditions gives the relationship, for a given energization period of the radiation source, of the maximum suitable current value for a chosen voltage for energizing this source.

The method is as follows. At a given voltage $V_{test}$ and a corresponding current $I_{test}$ applied to an X-ray source, an exposure measurement is performed at the area of an observation device to be exposed and with a given energization period of the radiation source. From this measurement a desired current value $I_{w1}$ associated with this voltage $V_{test}$ is found which will yield a certain density for photo or film. In the case of films and photos the energization period for an exposure measurement is equal to that for pick-up while with the use of a film exchanger a certain ratio between these energization periods can be taken. Through the point in FIG. 1 corresponding to the desired current value $I_{w1}$ and the given voltage value $V_{test}$ the curve 2 is provided which connects points with voltage and current values which would cause the same density. The point of intersection with the lowest voltage value of one of the two points of intersection of this curve 2 with the nomogram 1 is determined by $V_{min}$ and a current value $I_1$. This is the most suitable adjustment for the radiation source because in case of a maximum control of the source according to a nomogram value the radiation is obtained at the lowest possible voltage which yields the optinum contrast for photo or film.

In case of a large deviation between $V_{test}$ and V $min_1$ it may occur that the film density at the values found for $V_{min1}$ and $I_1$ will exhibit a slight deviation relative to the desired density. A subsequent exposure measurement is then performed using the previously determined voltage value $V_{min1}$ thereby yielding a desired current value $I_{w2}$, which may slightly deviate from the current value $I_1$ previously found. The curve 3 for a density associated with these new voltage and current values $V_{min1}$, $I_{w2}$ is drawn through the point with the last determined values and the point of intersection $V_{min2}$ with the nomogram 1 yields an associated value $I_2$ for the current which will then produce a more accurate approximation of the correct value. Although generally one or two exposure measurements are sufficient this procedure may be repeated, if desired, until the values found for $I_{wn+1}$ and $I_n$ substantially coincide, which will generally be the case after three exposure measurements.

By using a logarithmic current scale the curve 3 may be obtained by shifting the curve 2 in the vertical direction so that, for example, with the aid of a jig moved along a ruler this curve can be drawn in a simple manner through an arbitrary point in the graph so that the voltage and current values to be adjusted can be determined very quickly and simply even by persons that are not very skilled in the art or have little experience in the use of X-ray equipment.

The novel apparatus now will be described with reference to FIGS. 2 and 5. The reference numerals denoting the waveforms of FIG. 5 are keyed to the corresponding elements or terminals in FIG. 2, e.g. waveform 45' in FIG. 5 is the waveform at terminal 45 of pulse source 47.

In FIG. 2 an X-ray source 5 is connected to a conventional voltage control circuit 7 and a current control circuit 9, each having control signal inputs 11 and 13, respectively. The voltage control circuit 7 regulates the amplitude of the anode-cathode operating voltage of the x-ray tube as a function of an input control voltage at terminal 11, whereas current control circuit 9 regulates the amplitude of the filament current as a function of an input control signal at terminal 13. For example, U.S. Pat. No. 3,164,723 shows how a triode amplifier can be connected in series with an x-ray tube whereby the triode impedance can be varied by varying a control voltage applied to its control grid. A conventional x-ray voltage control circuit with a triode or power transistor connected in series with x-ray tube 5 and with its control electrode coupled to input terminal 11 would thus vary the operating voltage across tube 5 in response to a control signal appearing on input line 11. As to box 9, a transistor connected in series with the filament current transformer for tube 5 and with its control electrode coupled to input terminal 13 could be used to control the amplitude of the tube filament current as a function of a control signal thereat. The control signal input 11 is connected to an output 15 of a control loop 17 and the control signal input 13 is connected to an output 19 of a change-over switch 23 which can be operated by means of an operating device 21 switch 23 has a first input 25 connected to an output 37 of the control loop 17 and a second input 29 for applying a control obtained from an output terminal 31 of an operating range limitation function generator 32 to the control signal input 13. Consequently, when performing exposure measurement in which the change-over switch 23 assumes the position shown the current through the radiation source 7 is maintained at a given value $I_{test}$ with the aid of the current control circuit 9. This circuit 9, which is active in the filament circuit of the radiation source 5, cannot be controlled to a different value fast enough so as to make a quick succession of experimental exposures at different current values possible. The current control circuit 9 may be formed as described in U.S. Pat. No. 3,983,396.

The voltage representing $I_{test}$ and originating from the output terminal 31 of the operating range limitation function generator 32 is also applied to an input 33 of an X-ray exposure meter 35, a further input 37 of which is connected to an output 39 of a radiation-sensitive element 41. The exposure meter 35 has an input 43 which is connected to an output 45 of a conventional pulse signal source 47, such as a monostable-multivibrator the output 46 of the pulse signal source 47 also is connected to an input 49 of the voltage control circuit 7. The pulse signal source 47 thus ensures that a given exposure period of the radiation source 5, which period may be made adjustable with the aid of the operating device 21, can be obtained while also the exposure meter 35 is activated at the correct instant. The exposure meter 35 may receive information from the operating device, for example, about the film sensitivity to be used. However, since the film sensitivity information is not necessary in order to practice the invention, or for a proper understanding thereof, it will not be further described.

A control voltage corresponding to $V_{test}$ for the first exposure measurement of sequence is applied to the output terminal 15 from an output of the operating device 21. However, for subsequent exposure measurements of the same sequence, the currently stored value corresponding to $Vmin_n$ will be used.

After performing a first exposure measurement at a voltage $V_{test}$ and a current $I_{test}$ the exposure meter 35 applies a signal to an output 51. This signal is proportional to the logarithm of the current value $I_{wn}$ desired for a given density and associated with the voltage $V_{test}$ or $V_{min}$. This signal will hereinafter be referred to as log $I_{wn}$ and at the end of the first exposure measurement is log $I_{w1}$.

The signal log $I_{wn}$ is applied to a first input 53 of an adder and subtractor circuit 55. A second input 57 of this adder and subtractor circuit 55 is connected to an output 59 of a clamping circuit 61 which receives a pulse signal at an input 63 at the instant of the exposure measurement so that its output voltage is clamped at zero.

The clamping circuit 61 is controlled at an input 65 by a signal originating from an output 67 of a current-voltage function generator 69 receiving at an input 71 a voltage from the output 15 of the contral loop 17. This input voltage thus is a measure of the voltage applied to the radiation source 5 and during the first exposure measurement will correspond to $V_{test}$. A voltage proportional to the logarithm of the X-ray tube current value for a given density associated with a given voltage at the radiation source 5 is produced at its output 67. This signal is hereinafter referred to as log $I_z$. The function generator 69 may utilize conventional function generator design techniques for deriving a waveform of the type shown, for example, by reference numeral 2 in FIG. 1, and may consist of a logarithmgenerating diode network. Very precise approximations to a given waveform can be achieved by combining summers, potentiometers and multipliers, as is well known in the art, and as described, for example, in the textbook by Korn and Korn entitled, "Electronic Analog And Hybrid Computers" (McGraw-Hill Book, Co.; 1964), chapter 6.

This signal appears at the output 59 of the clamping circuit 61 and is shifted due to the operation of the clamping circuit 61 in such a manner that the generated function passes through the point which, after the $n^{th}$ exposure measurement, is associated with a desired current value $I_{wn}$ found for a corresponding test voltage value. This signal is then proportional to log $I_z$—log $I_{wn}$.

The adder and subtractor circuit 55 has a third input 73 which is connected to an output 75 of the operating range limitation nomogram function generator 32, an input 79 of which is connected to the output 15 of the control loop 17 and thus also receives a voltage which is a measure of the voltage applied by the voltage control circuit 7 to the radiation source 5. The signal at the output 75 is then proportional to the logarithm of the nomogram current value associated with that voltage and takes the general form of the curve 1 in FIG. 1. Function generator 32 also may be designed in accordance with the known teachings of the prior art, for example as described in chapter 6 of the above referenced textbook by Korn and Korn. This signal is hereinafter referred to as log $I_{ng}$.

An output 81 of the adder and subtractor circuit 55 is connected through a switch 83, which can be operated by means of the operating device 21, to a storage circuit 85, represented in this case by a capacitor 85. The output 15 of the control loop 17 is connected to the capacitor 85. Immediately after an exposure measurement the switch 83 is temporarily closed and the control loop 17 is made active. This control loop will then attempt to render the total input voltage of the adder and subtractor circuit 55 zero.

When the first input 53 and the second input 57 are each an adder input and the third input 73 is a subtractor input, the total input signal of the adder and subtractor circuit will become.

$$\text{Log } I_{wn}+(\text{Log } I_z-\text{Log } I_{wn})-\text{Log } I_{ng}.$$

This will be zero for log $I_z$=log $I_{ng}$, i.e. for a point of intersection of the load nomogram curve (1) and the curve (2, 3, etc.) for the desired density. By the choice of the phase of the feedback in the control loop this point of intersection is chosen at the lowest voltage value. The control loop then automatically applies to its output 15 the control voltage for obtaining $V_{minn}$ which is applied to the an X-ray tube voltage control circuit 7.

The above described circuit arrangement performs on a first command of the operating device 21 a first exposure measurement with the aid of a voltage $V_{test}$ which is determined by a voltage which is applied, before a series of measurements, to the capacitor 85 and is obtained from an output 87 of the operating device 21, which voltage with the aid of control circuit 7, produces the voltage $V_{test}$ at the radiation source 5. After the first exposure measurement the point corresponding to the current value $I_1$ is found for the radiation source 5 with the associated voltage value $V_{min}$. If a second exposure measurement is to be made, log $I_1$ is stored in clamp circuit 61. However, exposure meter 35 may not generate a signal log $I_{w2}$ because curve 2 is not precisely accurate for all input voltages. The signals stored or generated by clamp circuit 61 and exposure meter 35, respectively, are equal only if curve 2 is correct. If the signals differ the difference effectively causes a shift of the curve 2 to the curve 3. After the second exposure measurement we find $I_2$ and $V_{min2}$ and so forth. After termination of a series of exposure measurements the control loop 17 is interrupted with the aid of the switch 83 and the last voltage value found for $V_{minn}$ is stored in the capacitor 83. This voltage passes through the operating range limitation function generator 32 to derive at the output 75 the control voltage which will produce the current value $I_n$ for the X-ray tube 5. The changeover switch 23 which is then set to the upper position so that the voltage at output 75 controls the current control circuit 9 to supply the X-ray tube with the desired current intensity.

The function generators 69 and 32 may be realized in known manner with the aid of resistors, amplifiers and diode networks.

FIG. 3 uses the same reference numerals for the corresponding components shown in FIG. 2.

The input 37 of the exposure meter 35 receives a current during an exposure measurement from the radiation-sensitive element 41, which current is a measure of the radiation quantity passed by an object to be examined. This current is applied through a switch 89, which is closed during the exposure measurement, to an input 91 of a conventional difference amplifier 93 the other input of which is connected to ground. An output 95 of the amplifier is fed back through a capacitor 97 to the input 91. This amplifier constitutes, with the capacitor 97, an integrator circuit passing on the integrated input current to an input 101 of a logarithm-forming circuit 103. The capacitor 97 is shunted by a switch 99 which discharges the capacitor 97 after each exposure measurement.

An output 105 of the circuit 103 provides a voltage which is proportional to the logarithm of the passed radiation quantity at a voltage $V_{test}$ and a current $I_{test}$ applied to the radiation source 5.

This voltage is referred to as log $E_{test}$. This voltage is passed on through a switch 106 to a storage capacitor 107 so that it remains available after the exposure measurement. An input 109 of a conventional subtractor circuit 111 is connected to the capacitor 107 and receives continuously the voltage Log $E_{test}$. The voltage Log $I_{test}$ is applied via terminal 33 to another input 113, which voltage is a measure of the current intensity used for the radiation source. An output of the subtractor circuit 111 applies to the output 51 of the exposure meter 35 a voltage which is equal to Log $I_{test}$−Log $E_{test}$. This has been rendered equal to Log $I_w$ in a simple manner by the choice of a parameter for the exposure meter.

In the case of an exposure measurement the voltage $E_{test}$ obtained at the output 95 of the integrator 93, 97 varies with $I_{test}$, that is $E_{test}$=k $I_{test}$ where $I_{test}$, as already mentioned above, is the current through the radiation source during an exposure measurement. For a desired density of the film the voltage at the output 95 would have to be equal to $E_w$=k $I_w$ is the current through the radiation source 5 required to provide the desired density. The radio ($I_w/I_{test}$) is equal to the ratio ($E_w/E_{test}$) from which it follows that $$I_w=E_w(I_{test}/E_{test})$$

If for the desired density the output voltage of the integrator is chosen to be 1 V, then $E_w$=1 and $I_w$=($I_{test}/E_{test}$) and log $I_w$=log $I_{test}$=log $E_{test}$ which is the voltage at the output 51.

In FIG. 4 the input 65 of the clamping circuit 61 is connected to an input 115 of an adder circuit 117 an output 119 of which is connected to the output 59 and through a switch 121 closed during the exposure measurement to an integration circuit which is constituted by a capacitor 123 incorporated between an output and an input of a differential amplifier 125. The output of the latter amplifier 125 is connected to a second input 127 of the adder circuit 117.

When the switch 121 is closed the voltage at the input 127 of the adder circuit 117 will be adjusted in such a manner that the input voltage of the difference amplifier 125 becomes substantially zero so that the sum of the voltage at the input 127 and the voltage at the input 113 will thus become zero. This actually means a shift to zero of a voltage value applied to the input 115 or a zero clamping of the voltage at the output 119 during an exposure measurement.

The adder and subtractor circuit 55 includes an adder circuit 129 to which the inputs 53 and 57 are connected and an output 131 of which is connected through a resistor 133 to an input 143 of a difference amplifier 137. An output 139 of the difference amplifier 137 is connected to the output 81 and through a resistor 141 to the input 135. The input 73 is connected via a potential divider 143, 147 to the input 135.

A voltage may be derived, if desired, from the output 131 of the adder circuit 129, which voltage is also a measure of the desired current adjustment of the radiation source 5. For this voltage, however, the store 85 is no longer active because the clamping circuit is present in this circuit. The voltage at the output 131 may be used for example to detect whether during an exposure measurement a controlled state exists in the control loop 17. When this is not the case the voltage at the output 101 will exceed a given value and may be used to cause a variation of one or more parameters or for blocking the operation of the X-ray tube.

The described arrangement is very suitable for angiography.

The voltage scale used in the method and the device for the characteristic may be arbitrarily chosen. A logarithmic scale value use for the voltage coordinate may be advantageous since it is then possible to obtain the same percentual accuracy.

It will be evident that the described method can not only be formed with mechanical and analog electrical means but for example also with digital electronic circuits or by hand using only conventional meters for measuring current and voltage. When using, for example, sufficient stores of a computer program or of a multiplier circuit for obtaining the current voltage functions, even the use of a logarithmic current scale may be unnecessary.

What is claimed is:

1. A method of determining voltage and current values to be applied to an x-ray source and associated with a given exposure period of the x-ray source in which a desired current time product is determined with the aid of an x-ray exposure meter for a desired radiation quantity comprising, determining the current time product at a given voltage applied to the radiation source, and determining, with the aid of a voltage-current function related to the desired radiation quantity, which function is passed through the current intensity associated with the desired current time product, and with the aid of an operating range limitation nomogram of the X-ray source with the same current scale as the voltage-current function, the point of intersection of the voltage-current function and the operating range limitation nomogram having the lowest voltage value, said lowest voltage value being taken as a target value for the current determination with the aid of the load nomogram.

2. A method as claimed in claim 1, characterized in that the current scale is a logarithmic current scale and that the voltage-current function is passed through the current intensity associated with the desired current time product by shifting the voltage-current function parallel to the current coordinate.

3. A method as claimed in claim 1 wherein, with the aid of a subsequent x-ray exposure measurement made at the previously determined lowest voltage value, a further lowest voltage value is obtained by repetition of the method as claimed in claim 1.

4. A method of finding the optimum values of voltage and current to be applied to an x-ray radiation tube for a given exposure period thereof comprising, energizing the x-ray tube with a given operating voltage, deriving the tube current by means of an x-ray exposure meter for said given voltage and said given exposure period thereby determining the desired current-time product of the x-ray tube, using a voltage-current function related to the desired radiation quantity and which passes through the values of said operating voltage and the derived tube current to determine the point of intersection of the voltage-current function with the tube operating range limit nomogram having the lowest voltage value, the tube current corresponding to said intersection point representing the optimum tube current and the tube voltage corresponding to said intersection point representing the optimum tube voltage for said given exposure period to obtain the desired radiation quantity.

5. A method as claimed in claim 4, further comprising supplying a given control signal to the tube while energizing the tube with said given operating voltage so that a predetermined tube current flows during the exposure period.

6. A method as claimed in claim 5 further comprising repeating the steps of claim 5 to make a second exposure measurement but using as the tube operating voltage the tube voltage corresponding to said intersection point and determined by a first exposure measurement which used said given operating voltage as the tube voltage.

* * * * *